US005307908A

United States Patent [19]

Shyr et al.

[11] Patent Number: 5,307,908

[45] Date of Patent: May 3, 1994

[54] EXPANDABLE TOTE BAG WITH WHEELS

[76] Inventors: Michael H. Shyr; Godfrey Shyr, both of 623 Vineland Ave., La Puente, Calif. 91746

[21] Appl. No.: 992,565

[22] Filed: Dec. 18, 1992

[51] Int. Cl.[5] ..... A45C 5/14; A45C 7/00

[52] U.S. Cl. ..... 190/18 A; 190/103; 190/111

[58] Field of Search ..... 206/315.1; 190/18 R, 190/18 A, 103-105, 109, 112, 107, 127; 383/2

[56] References Cited

U.S. PATENT DOCUMENTS

| | | | |
|---|---|---|---|
| 1,137,579 | 4/1915 | Cohn | 190/110 |
| 1,341,099 | 5/1920 | Abramson | 190/103 |
| 2,018,809 | 10/1935 | Rodgers | 190/107 |
| 2,517,757 | 8/1950 | Adlerstein . | |
| 3,185,271 | 5/1965 | Kotkins | 190/18 R X |
| 3,443,671 | 5/1969 | Dyke | 190/110 X |
| 4,334,601 | 6/1982 | Davis | 190/111 X |
| 4,361,215 | 11/1982 | Sawai | 383/2 X |
| 4,418,804 | 12/1983 | Bradley et al. | 190/18 A |
| 4,752,008 | 6/1988 | Pratt | 190/109 X |
| 4,756,394 | 7/1988 | Cohen | 190/108 |
| 4,773,515 | 9/1988 | Kotkins, Jr. | 190/103 |
| 4,805,748 | 2/1989 | Gerch | 190/103 |
| 4,805,749 | 2/1989 | Gerch | 190/111 |
| 4,817,802 | 4/1989 | Pratt | 190/109 X |
| 4,830,154 | 5/1989 | Gerch et al. | 190/103 |
| 4,953,673 | 9/1990 | Ambasz | 190/127 X |
| 5,022,574 | 6/1991 | Cesari | 190/18 A X |
| 5,042,664 | 8/1991 | Shyr et al. | 206/579 |
| 5,048,649 | 9/1991 | Carpenter et al. | 190/18 A |
| 5,209,327 | 5/1993 | Wright et al. | 190/18 A |
| 5,209,328 | 5/1993 | Kotkins, Jr. | 190/111 X |

FOREIGN PATENT DOCUMENTS

| | | | |
|---|---|---|---|
| 691689 | 7/1965 | Italy | 190/111 |
| 1265395 | 3/1972 | United Kingdom | 190/103 |
| 2080220 | 2/1982 | United Kingdom | 190/103 |
| 2173393 | 10/1986 | United Kingdom | 190/103 |
| 2231846 | 11/1990 | United Kingdom | 190/18 A |

*Primary Examiner*—Sue A. Weaver
*Attorney, Agent, or Firm*—Price, Gess & Ubell

[57] ABSTRACT

An improved expandable tote bag has an upper storage unit and a contractible central unit that is mounted above a lower storage base unit. The base unit includes a support assembly that can mount wheel assemblies for enabling the traveler to pull the luggage across the support surface. The upper storage unit and central unit can be pivoted to one side of the lower base unit to enable full access to items stored in the base unit.

9 Claims, 2 Drawing Sheets 2
4
6
8
10
12
14
16
18
20
22
24
26
28
30
32
34
36
38
40
42
44

EXPANDABLE TOTE BAG WITH WHEELS

BACKGROUND OF THE INVENTION

1. Field of the Invention

This invention relates to luggage bags and, more particularly, to an expandable luggage bag having an upper storage unit that can be expanded and a lower base unit that can be transported over a support surface and can be exposed for storage purposes when the upper storage unit is pivoted to one side.

2. Description of Related Art

Considerable efforts have been made to address the travel needs of both casual and business travelers with luggage items. In recent years, a large number of flexible luggage bags have been proposed and commercially sold. Examples of such devices are duffle bags, shown in U.S. Pat. Nos. 4,805,748 and 4,830,154.

Various forms of utility bags have also been sold having the capacity to collapse one or more compartments of the bag for purposes of easy storage and transportation, such as U.S. Pat. Nos. 4,334,601 and 5,042,664. The modern day travelers, however, are constantly requiring innovations in the luggage field in order to provide easy access and easy movement of the luggage. Thus, there is still a demand in the luggage field to address these concerns.

SUMMARY OF THE INVENTION

The present invention is directed to an expandable luggage bag having a hollow base unit that is capable of supporting a plurality of wheel assemblies to enable the operator to transport the bag by manual pulling with a strap. An upper storage unit is connected via a central expandable unit to the hollow base unit and extends upward with a closable opening extending across its upper portion. The central unit includes a flexible cover member that extends across the hollow base unit and around the peripheral sides of the central unit so that it is a common extension with the walls of the upper storage unit. The peripheral side of the central unit can be extended and retracted by virtue of a zipper assembly that when in an open mode enables an expansion of the flexible cover member side and when in a closed mode, enables a retraction of the flexible cover member side. Thus, the overall dimensions of the luggage bag can be adjusted by activation of the zipper assembly on the central unit to either increase the storage space available or to reduce it to facilitate transportation and storage purposes. Another zipper assembly extends partially about the interface between the hollow base unit and the central unit, and when this zipper assembly is opened, it is capable of pivoting both the central unit and the upper storage unit to one side of the base unit to thereby expose the opening in the hollow base unit without interfering with the items stored in, respectively, the upper storage unit and the central unit. The ability to access a storage base in the base unit is independent of whether the central unit has been expanded or retracted and thus, the traveler has easy access to items at the bottom of the luggage bag without disturbing the contents of the central unit and the upper storage unit. Conversely, however, when the traveler wishes to transport the luggage bag, the bag can be unitarily moved and the heavier items that most travelers traditionally attempt to locate at the lower portion of their bag can still be conveniently stored at that position for both the stability of the luggage bag during travel and to prevent damage to more delicate or fragile items stored above. For example, shoes, toilet kits, shampoos, hair dryers, etc., can be conveniently stored in the base unit.

The base unit preferably includes a support assembly having a support carriage member formed of an integrally-molded shell housing having a planar surface and a side flange. A reinforcing plate or member of a dimension that fits within the shell member provides additional stability and an anchor support for the plurality of wheel assemblies attached to the exterior surface of the shell member. A semirigid retaining member can be mounted on the shell member and extends upward towards the central unit to maintain the integrity and shape of the base unit for storage purposes.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide an improved expandable tote bag.

Figures 1, 2, 3:
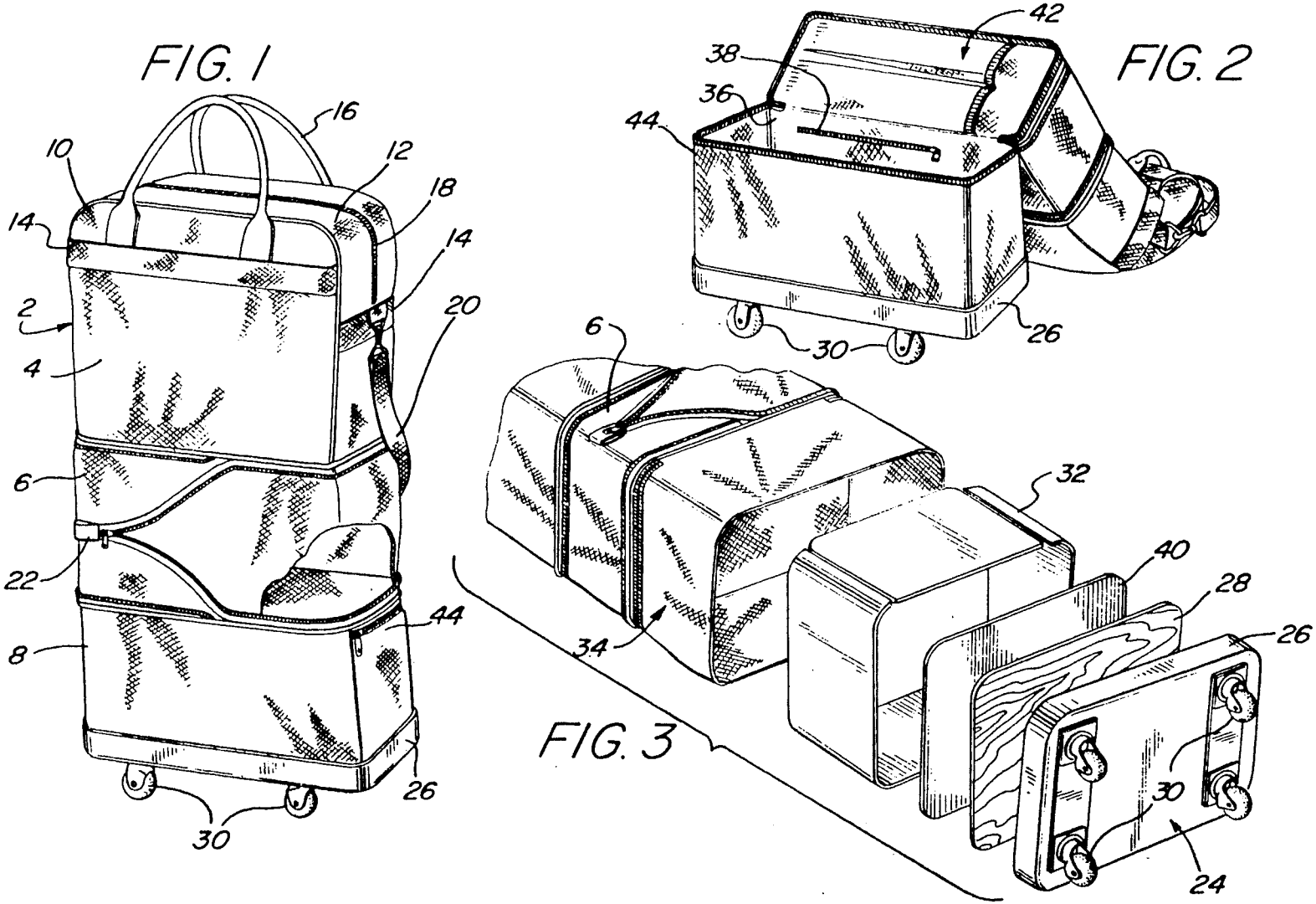
FIG. 1 is a perspective view of the luggage bag of the present invention in an expanded configuration with a partial cutaway to disclose a bottom portion of the central unit.
FIG. 2 is a perspective view disclosing the central unit and the storage unit pivoted to one side to expose an opening of the base unit.
FIG. 3 is a perspective exploded view to show the configuration of the base unit.

Referring to FIG. 1, the expandable luggage bag 2 is disclosed in an expanded mode of operation for maximum storage purposes. An upper storage unit 4 is interconnected with a central unit 6, which in turn is connected to a base unit 8. A flexible cover member 10 forms the outer perimeter or envelope of the luggage bag 2 and extends downward from the storage unit 4 into the contracting central unit 6. Various panels of flexible material can be utilized, as known in this industry, for example, a combination of a fabric impregnated with plastic or rubberized material can be used having sufficient durability while being lightweight. Various forms of cloth, flexible plastic or rubber, canvas, and nylon material are also well known in the luggage industry for this purpose. The same material 12 as the flexible cover member 10 is also extended around the outer peripheral surface of the base unit 8 and, preferably, a common design or pattern can be utilized as an attractive feature to add an ornamental appearance to the luggage bag 2. As is known in the industry, various panels of this flexible cover material can be sewn together to create the configuration disclosed in FIG. 1.

Plastic ribbing or tubing 13 can be utilized across the peripheral edges of the upper storage unit 4 to provide a degree of stability and rigidity when the luggage bag 2 is empty. Additionally, reinforcing straps 14 of a woven cotton or nylon and handles 16 can be attached to the upper storage unit 4. An access opening can be controlled by a sealing zipper assembly 18 and extends entirely across the upper surface and respective sides of the upper storage unit 4, as seen in FIG. 1. A strap 20 can be detachably mounted to a hook on the upper storage unit 4 to enable the traveler to pull the luggage bag 2 across a support surface.

Figure 4:
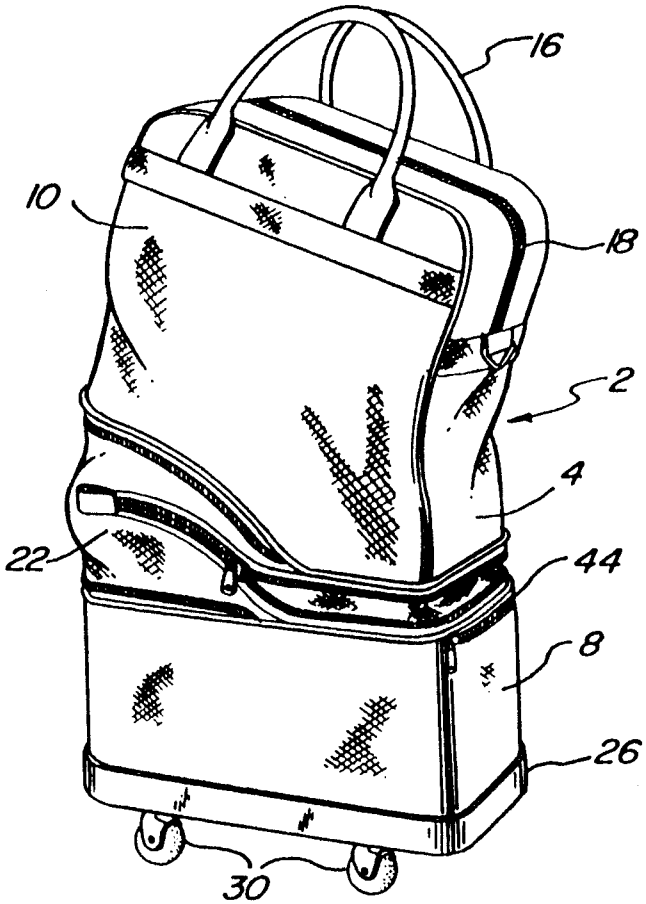
FIG. 4 is perspective view disclosing the process of contraction of the central unit.

The central unit 6 is a continuation of the upper storage unit 4, with the same flexible covering member supporting a zipper assembly 22 to enable a contraction and expansion of the central unit 6. The various tracks of zipper prongs are vertically displaced to define the upper and lower vertical boundaries of the central unit adjacent supporting plastic tubing. As can be seen in FIG. 4, when the pull of the zipper assembly 22 is activated, the central unit 6 is folded inward to enable a retraction of the flexible cover member 10. When the zipper assembly 22 is opened, as shown in FIG. 1, there is an expansion of the flexible cover member to provide the optimum storage capabilities. The flexible cover member further extends across the base unit 8 and forms a flexible bottom structure to the central unit 6. The support assembly of the base unit 8 includes a support carriage member 24 having a planar surface that can be molded from a plastic material, and can further include reinforcing ribs or support grooves (not shown).

Integrally extending upward from the planar surface is a peripheral flange 26 that adds a degree of rigidity to the support carriage 24. A reinforcing member 28, such as a ⅜-inch plywood member having the same perimeter configuration as the planar surface, can be mounted on the inside of the support carriage 24, and can receive appropriate fasteners such as rivets for supporting each of the wheel assemblies 30. Alternative materials can be used for the reinforcing member 28, such as plastic and metal. As can be seen, four separate wheel assemblies 30 are appropriately connected adjacent each of the corners of the support carriage 24. The individual wheel assemblies 30 can freely pivot. A two-part retainer member 32 can extend upward to form a semirigid internal side wall to the base unit 8. Thus, one portion of the retainer member can have a U-shaped configuration, and the other can be a rectangular plate. Their combined arrangement ensures a constant configuration to the base unit 8. An exterior cover member 34 extends over the retainer member 32 and is fastened to the flange 26. An interior nylon liner 36 covers the inner surface of the base unit 8 and can include appropriate zipper pockets 38 for providing additional storage within a side of base unit 8, as seen in FIG. 2.

A bottom liner 40, such as a piece of thin matching plastic, can cover the reinforcing member 28 to complete the internal configuration of the base unit 8.

As can be seen in FIG. 2, extending across the bottom surface of the central unit 7 is a divided nylon storage pouch 42 that can be configured to support a pair of shoes.

One surface of a side wall of the base unit 8 extends into the nylon pouch member 42 and forms a flexible pivot which interfaces between the central unit 7 and the base unit 8. A zipper assembly 44 extends around each of the remaining sides of the base unit 8 and the lower surface sides of the central unit 6. When the zipper assembly 44 is in an open mode of operation, the upper storage unit 4 and central unit 6 are pivoted to one side of the base unit 8 to fully expose the opening in the hollow base unit 8 for storage purposes. When the zipper assembly 44 is in a closed configuration, the luggage bag 2 takes the configuration shown in FIGS. 1, 4, and 5. The zipper assembly 44 is separated by plastic tubing from the contracting zipper assembly 22.

Figure 5:
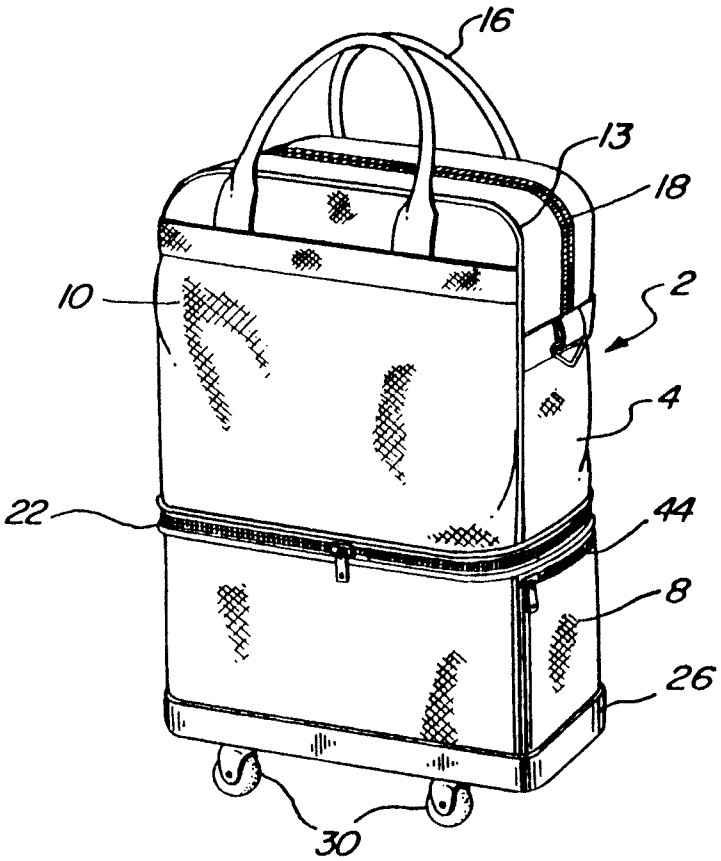
FIG. 5 is a perspective view disclosing the luggage bag in a contracted mode of operation.

In operation, the traveler can decide which configuration of the luggage bag 2 he or she wishes to utilize, either the expanded form shown in FIG. 1 or the contracted form shown in FIG. 5. After selecting the appropriate storage capacity, he or she preferably loads the hollow base unit 8 by activating the base unit zipper assembly 44 to an open configuration, as shown in FIG. 2. The appropriate items are then loaded, and usually constitute the heavier items he or she wishes to travel with, to thereby ensure a low center of gravity for the luggage unit 2. As can be seen, the upper storage unit 4 and central storage unit 6 are pivoted to completely open the base unit 8 for storage purposes, as shown in FIG. 2. After the appropriate storage of the items in the base unit 8, the base unit zipper assembly 44 is then closed so that the luggage bag 2 assumes its operative vertical position.

Assuming that maximum storage is desired, the zipper assembly 22 is activated on the central unit 6 to permit the expansion of the central unit 6 to its maximum storage capability. The traveler can now open the upper storage unit 4 by opening the zipper assembly 18, and can appropriately pack the desired items. Upon completion of this operation, the traveler is capable of pulling the packed luggage bag 2, either by the handle 16 or, preferably, a pulling strap 20. As can be appreciated from FIG. 5, the traveler also has the option of reducing the storage space by contracting the central unit 6 through activation of the zipper assembly 22, as discussed above. As can be readily appreciated, the traveler can at any time access the items stored in the lower base unit 8 by opening the zipper assembly 44 without disturbing the items stored in the upper storage unit 2 and central unit 6.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An expandable luggage bag comprising:

a hollow base unit including a relatively rigid support assembly and a plurality of wheel assemblies mounted on the support assembly to enable operator transportation of the bag, the base unit including an integrally-molded shell member having a planar surface and a side flange;

a central unit including a flexible cover member extending across the hollow base unit, thereby defining a bottom surface, and extending around the central unit, thereby defining a peripheral side of the central unit, the flexible cover member including a first zipper assembly vertically displaced around the peripheral side, such that the first zipper assembly, when opened, enables an expansion of the flexible cover member, increasing a storage capacity of the central unit and, when closed, enables a retraction of the flexible cover member with the peripheral side of the central unit folding inward, decreasing the storage capacity of the central unit;

a storage unit connected to the central unit and integral with the flexible cover member, the flexible cover member having a closable opening extending across an upper portion of the storage unit;

means for pivoting the central unit and storage unit to one side of the base unit to expose an opening in the hollow base unit for storage purposes; and a retainer member mounted on the shell member and extending upward to the central unit to form a semirigid internal side wall to the base unit to maintain its shape for storage purposes.

2. The luggage bag of claim 1 wherein the bottom surface of the flexible cover member includes a storage pouch of a dimension to retain a pair of shoes.

3. The luggage bag of claim 1 further including a reinforcing member of a dimension to fit within the shell member and supporting the plurality of wheel assemblies.

4. The luggage bag of claim 1 wherein the means for pivoting includes a second zipper assembly extending partially around the upper portion of the base unit immediately above the retainer member.

5. An expandable, vertically upright luggage bag comprising:

a hollow base unit including a relatively rigid support assembly, a plurality of wheel assemblies mounted on the support assembly to enable operator transportation of the bag, and a relatively-sized side wall;

a central unit including a flexible cover member extending across the hollow base unit, thereby defining a bottom surface and extending around the central unit, thereby defining a peripheral side of the central unit, the flexible cover member including a first zipper assembly vertically displaced around the peripheral side, such that the first zipper assembly, when opened, enables an expansion of the flexible cover member, increasing a storage capacity of the central unit and, when closed, enables a retraction of the flexible cover member with the peripheral side of the central unit folding inward, decreasing the storage capacity of the central unit, the bottom surface including a storage pouch of a dimension to retain a pair of shoes;

a storage unit connected to the central unit and integral with the flexible cover member, the flexible cover member having a closable opening extending across an upper portion of the storage unit, the storage unit being larger than either the base unit or the central unit; and means for pivoting the central unit and storage unit to one side of the base unit to expose an opening in the hollow base unit for storage purposes, including a second zipper assembly extending between the base unit and the central unit.

6. The luggage bag of claim 5 wherein the base unit includes an integrally-molded shell member having a planar surface and a side flange.

7. The luggage bag of claim 6 further including a reinforcing member of a dimension to fit within the shell member and supporting the plurality of wheel assemblies.

8. The luggage bag of claim 6 further including a retainer member mounted on the shell member and extending upward to the central unit.

9. An expandable, vertically upright luggage bag comprising:

a hollow base unit including a relatively rigid support assembly, a plurality of wheel assemblies mounted on the support assembly to enable operator transportation of the bag, the base unit including an integrally-molded shell member having a planar surface and a side flange;

a central unit including a flexible cover member extending across the hollow base unit, thereby defining a bottom surface and extending around the central unit, thereby defining a peripheral side of the central unit, the flexible cover member including a first zipper assembly vertically displaced around the peripheral side, such that the first zipper assembly, when opened, enables an expansion of the flexible cover member, increasing a storage capacity of the central unit and, when closed, enables a retraction of the flexible cover member with the peripheral side of the central unit folding inward, decreasing the storage capacity of the central unit, the bottom surface including a divided storage pouch configurable to support a pair of shoes;

a storage unit connected to the central unit and integral with the flexible cover member, the flexible cover member having a closable opening extending across an upper portion of the storage unit;

means for pivoting the central unit and storage unit to one side of the base unit to expose an opening in the hollow base unit for storage purposes, including a second zipper assembly extending between the base unit and the central unit; and a retainer member mounted on the shell member and extending upward to the central unit to form a semirigid internal side wall to the base unit.

* * * * *